US005125155A

United States Patent [19]

Kyle et al.

[11] Patent Number: 5,125,155

[45] Date of Patent: Jun. 30, 1992

[54] PROCESS OF MAKING AN INSULATED DOOR

[75] Inventors: Donald B. Kyle, North Little Rock; Michael A. Frost, Little Rock, both of Ark.

[73] Assignee: United Dominion Industries, Inc., Charlotte, N.C.

[21] Appl. No.: 538,142

[22] Filed: Jun. 14, 1990

[51] Int. Cl.[5] ..... E06B 3/48

[52] U.S. Cl. ..... 29/897.32; 29/469.5

[58] Field of Search ..... 29/897.32, 458, 469.5; 52/782, 792, 404; 49/501, DIG. 2; 428/201; 160/236

[56] References Cited

U.S. PATENT DOCUMENTS

| | | | |
|---|---|---|---|
| 2,924,860 | 2/1960 | Parham, Jr. et al. . | |
| 3,225,505 | 12/1965 | Lytz . | |
| 3,540,116 | 11/1970 | Drahos et al. | 29/469.5 X |
| 4,008,745 | 2/1977 | Bailey | 160/236 X |
| 4,085,558 | 4/1978 | Albrecht | 29/897.32 X |
| 4,499,645 | 2/1985 | Luomanen | 29/469.5 X |
| 5,060,711 | 10/1991 | Fimbell, III | 160/236 X |

*Primary Examiner*—Timothy V. Eley
*Attorney, Agent, or Firm*—Shefte, Pinckney & Sawyer

[57] ABSTRACT

A door assembly and method for making a door assembly that has a front steel skin with a predetermined embossed pattern, a back steel skin that has a substantially textured flush surface and a polystyrene core one side of which has an embossed design substantially identical to the embossed design of the front steel skin and a back surface that is substantially flush. The front and back steel skins have a pressure sensitive hot melt adhesive applied thereto and the center polystyrene core is attached between the front and back steel skins and passed through a series of pinch rollers to apply predetermined pressure to the front and back skins to secure the front and back skins to the polystyrene core. The front and back skins are preheated to a predetermined temperature sufficient to maintain the pressure sensitive hot melt glue in a soft and tacky state. The assembly is then passed through a series of pinch rollers to apply a predetermined pressure at a predetermined rate to the front and back skins to cause the bonding between the adhesive and the front and back metal skins and the polystyrene core. End caps are placed on the panel and, where a garage door may be involved or a door requires a weather seal, a retainer is placed on the bottom of the panel with weatherstripping inserted in the retainer to provide a weather-tight seal at the bottom of the door.

13 Claims, 4 Drawing Sheets

PROCESS OF MAKING AN INSULATED DOOR

FIELD OF THE INVENTION

The present invention relates to doors in general and in particular to a door formed of panels in which a lightweight expanded polystyrene material is bonded to steel front and back skins.

BACKGROUND OF THE INVENTION

It known in the prior art to form thermally insulating doors or fire-resistant doors. In U.S. Pat. No. 2,924,860, there is disclosed a thermally insulating door comprising a block of expanded polystyrene provided with cover sheets of relatively thin, strong hard material such as fiber glass laminated by polyester resin to mahogany plywood. The patent states that additional strength may be provided by employing a lamination including a hard board such as wood, plywood, metal or the like between the fiber glass and the foamed or expanded plastic slab or block.

In U.S. Pat. No. 3,225,505, there is disclosed a door having a continuous expansion joint between a substantially fireproof core and a fire-resistant frame. The core is produced from expanded mineral particles which, with the aid of mineral fibers and a mineral binder, are united inseparably together to form a unitary rectangular panel. The door may be made of smaller pieces if they are formed along their meeting edges with a tongue and groove joint. The outer skins have adhesive applied to the inner sides thereof and the fireproof core. The adhesive is a thermo-setting adhesive with a cold press time for bonding the skins to the core and the frame. The adhesive applied is applied by a power glue spreader.

There are a number of problems with the prior art doors. In the latter case, U.S. Pat. No. 3,225,505 requires the outer skin to be formed of three plies that are permanently bonded together into a unitary structure. When the plywood skins are positioned upon opposite faces of the core and frame of the door, a suitable adhesive spread is applied thereto and to the inner faces of the skins. The adhesive is a thermo-setting adhesive having a working life of 24 hours, an assembly time of 15 to 20 minutes, and a cold press time of 24 minutes. The glue or adhesive is applied by a power glue spreader. There is a great deal of cost in making such doors because of the construction of the three plies forming the outer skin permanently bonded together, the preparation of the core and the application of glue to both the core and the outer skins and using a cold press to bond the skins to the core.

In U.S. Pat. No. 2,924,860, the core material is polystyrene but the outer layer is fiber glass laminated to another layer such as mahogany plywood, asbestos, cement board, metal, fiber board, or plastic materials. Hardware is attached to the outside thereof with screws immersed in screw holes filled with flowable plastic material that hardens around the screw to hold the screw in the polystyrene.

The present invention overcomes the disadvantages of the prior art by providing a door which is light in weight, is environmentally safe because of the components used and the manner of manufacture, acts as an insulator, and is durable. The door formed could be a door applicable to buildings generally for ingress and egress, or may form a garage door by coupling several door panels together. For purposes of simplicity, the present case will be discussed in terms of a garage door although, as stated earlier, it is equally applicable to other doors for ingress and egress.

In the present invention, a steel skin for the front of the door or door panel is embossed and textured with a predetermined pattern. A polystyrene panel is molded having the same predetermined pattern on one side thereof and a relatively smooth textured surface on the other side. A substantially flush textured steel back skin is formed. The embossed steel is preheated to a temperature necessary to receive a pressure sensitive hot melt adhesive on the back side thereof without actually cooling the adhesive by conducting the heat away from the hot adhesive to the cold steel. The pressure sensitive hot melt adhesive is sprayed on the back side of the embossed skin and the molded polystyrene panel having the corresponding pattern as the embossed steel is mated with the steel front skin to form a first assembly. The front embossed skin is, as stated previously, preheated to the point that it does not substantially conduct the heat from the hot melt adhesive until the bonding can take place between the steel and the polystyrene core. The pressure sensitive hot melt adhesive is also applied to the inside of the steel back skin and then the back skin is mated to the smooth side of the molded polystyrene panel in the first assembly to form a second assembly having the front and back steel skins with the molded panel as a core. Hot melt adhesive is applied on the inside of the end caps and then they are mated with the ends of the second assembly. The second assembly is then heated to a temperature sufficient to keep the hot melt adhesive soft and tacky and, while at that temperature, pressure is applied in the range of 15 to 25 pounds per square inch to the second assembly by a series of rollers to create the adhesive bonds between the front and back steel skins and the polystyrene core. Metal end caps are formed to cover the exposed polystyrene ends.

By this method, a door or door panel is constructed that is lightweight, environmentally safe, insulating and durable.

When a plurality of the door panels are attached together by hinges, a garage door results.

SUMMARY OF THE INVENTION

Thus, the present invention relates to a process of making a door comprising the steps of embossing a steel skin for the front of the door with a predetermined pattern, molding polystyrene panels having the predetermined pattern on one side thereof and a relatively smooth surface on the other side, forming a substantially flush textured steel back skin, preheating the embossed steel skin for the front of the door, applying a pressure sensitive hot melt adhesive on the back side of the preheated embossed skin, mating the molded polystyrene panels having the corresponding pattern with the embossed steel pattern of the front steel skin to form a first assembly, applying the pressure sensitive hot melt adhesive on the inside of the steel back skin, mating the adhesive side of the back skin to the remaining molded panel side of the first assembly to form a second assembly having the panels as a core assembly, heating the second assembly to a temperature sufficient to keep the hot melt adhesive soft and tacky, applying pressure in the range of 15 to 20 pounds per square inch to the second assembly to create the adhesive bond between the steel skins and the panel, forming metal end caps to cover the exposed polystyrene ends, applying hot melt adhesive to the inner side of the end caps and mating the end caps with the ends of the second assembly.

The invention also relates to a door assembly comprising a metal front skin embossed with a predetermined pattern, a pressure sensitive adhesive applied as a hot melt to the inside of the metal front skin, a molded polystyrene core embossed on one side with the same pattern as the front skin and having a substantially flush back surface and secured with the adhesive in superimposed mating relationship to the back of the metal front skin, a substantially flush textured metal back skin, a pressure sensitive adhesive applied as a hot melt to the inside of the metal back skin for securing the metal back skin under a predetermined pressure to the flush back surface of the polystyrene core, recessed areas formed on the back of the polystyrene core in predetermined areas, metal hinge reinforcement plates placed in and attached with hot melt adhesive to the recessed areas before the metal back skin is attached, and orifices formed in the metal back skin and through the reinforcement plates for attaching hinges external to the metal back skin.

BRIEF DESCRIPTION OF THE DRAWINGS

These and other objects of the present invention will be more fully understood in conjunction with the accompanying specification and the attached drawings in which like numbers represent like elements and in which.

DETAILED DESCRIPTION OF THE DRAWINGS

Figure 1:
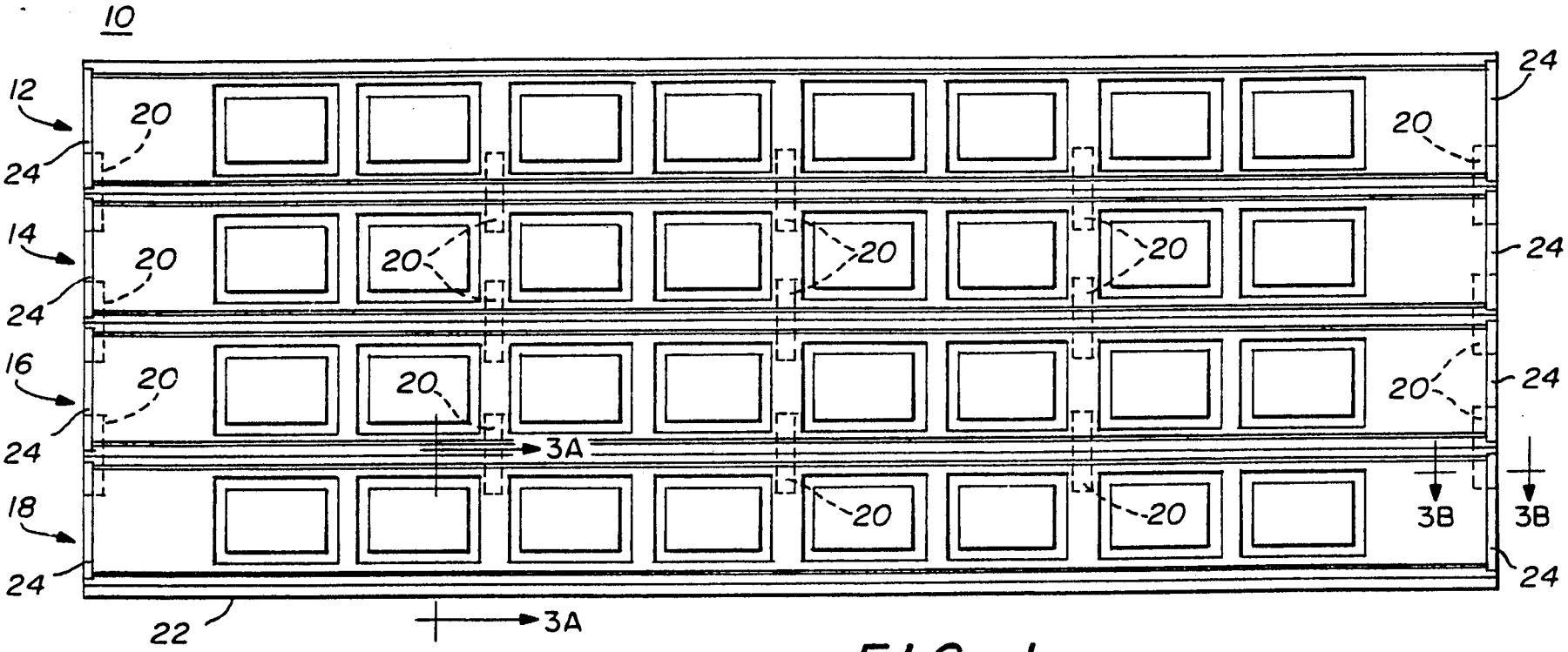
FIG. 1 is a front view of a garage door made with the novel panels of the present invention.
Figure 2:
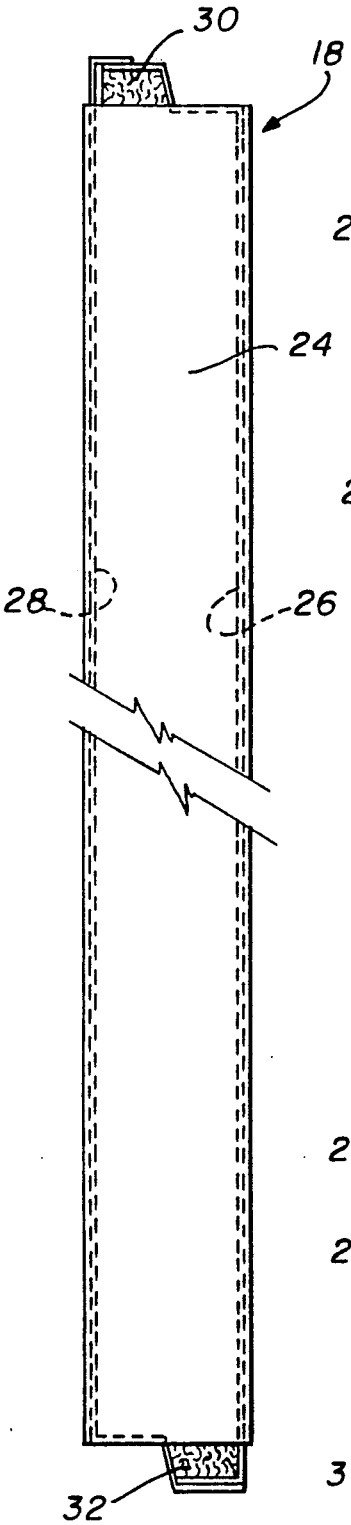
FIG. 2 is an end view of the bottom panel of FIG. 1 as seen from the left side thereof.
Figure 3A:
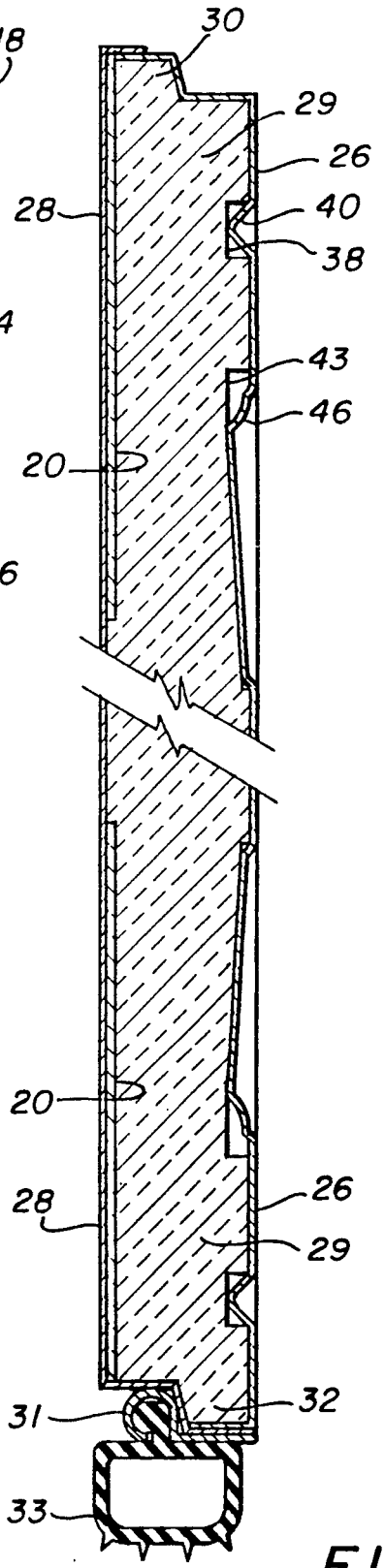
FIG. 3A is a cross section of the lower panel in FIG. 1 taken along section lines 3A—3A.
Figure 3B:
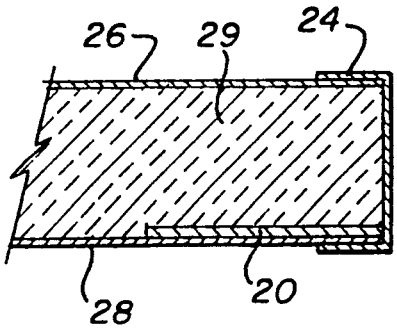
FIG. 3B is a partial cross section of the lower panel in FIG. 1 taken along lines 3B—3B.

Door 10 in FIG. 1 is representative of the front view of a garage door that is made of a plurality of individual panels 12, 14, 16 and 18 that are coupled to each other by means of hinges (not shown) attached to hinge plates 20. On the bottom of the door is a weatherstrip 22. Each end of each panel is covered with an end cover 24 that covers the exposed polystyrene core. A separate view of one of the panels 18, the lower panel in FIG. 1, is shown in FIGS. 2, 3A and 3B. FIG. 2 is an end view of the panel 18 in FIG. 1 as seen from the left side and illustrates the end cap 24 covering a front steel embossed skin 26 and a textured flush back steel skin 28. Projections 30 and 32 extend above and below the panel 18, respectively.

FIG. 3A is a cross-sectional view of one of the panels 18 in FIG. 1 taken along lines 3A—3A. As can be seen in FIG. 3A, an embossed front panel 26 is attached to a core member 29 made of polystyrene, the polystyrene having on one side essentially the same shape as the embossed front panel 26. Thus, the rectangular channel 38 in the polystyrene core 29 receives the indentation 40 in the embossed front panel 26. In like manner, the L-shaped portion 43 receives the curved portion 46 of front panel 26. Embossed or formed in the back side of polystyrene core panel 29 is a recess 21 for receiving a hinge plate 20. This embossed or recessed area 21 will be discussed in more detail hereafter in relation to FIGS. 5, 6 and 7. Each upper and lower end of the panel has a projection 30 and 32. The extension 32 at the bottom thereof allows a U-shaped retainer plate 31 to be attached thereto such as by screws so that a boot or weatherstrip 33 can be inserted in the retainer plate 31 to allow a weather-tight seal to be formed at the bottom of the door. Otherwise, the extensions 30 and 32 form an overlapping seal with the other panels.

FIG. 3B is a cross-sectional portion of the end of the panel shown in FIG. 2 and illustrates the end cap 24 in its place over the edges of the front wall 26 and the back wall 28 and covering the end of the exposed polystyrene structure 29. Hinge plate 20 is shown under the back skin 28.

Figure 4:
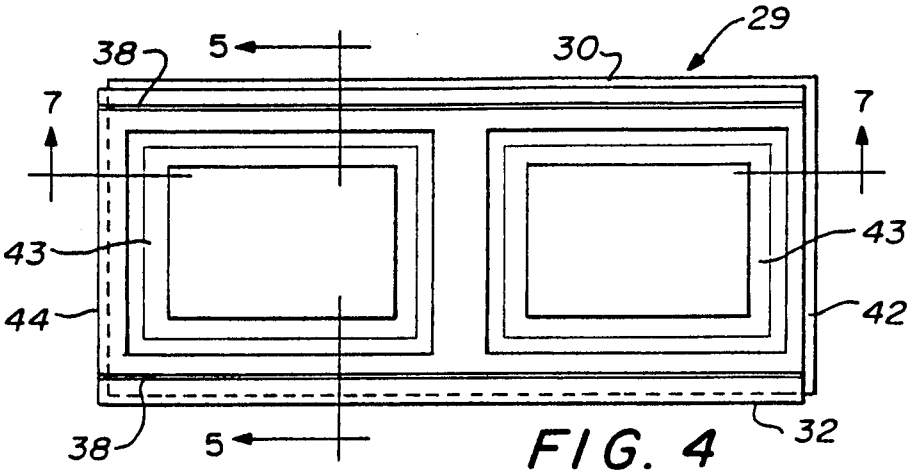
FIG. 4 is a front view of one of the polystyrene panels utilized in forming the composite panel of the present invention.

FIG. 4 is a front view of the polystyrene panel used as the core 29 of the novel door. It can be seen that the polystyrene panel has embossed on the front side thereof essentially the same shape as that shown in the metal front skin in FIG. 1. Channels 38 in the top and the bottom of the polystyrene core panel 29 are formed to receive the indentation 40 in the front metal panel 26. The projections 30 and 32 are also shown in FIG. 4 in the top and the bottom, respectively, of the panel 29.

Figure 5:
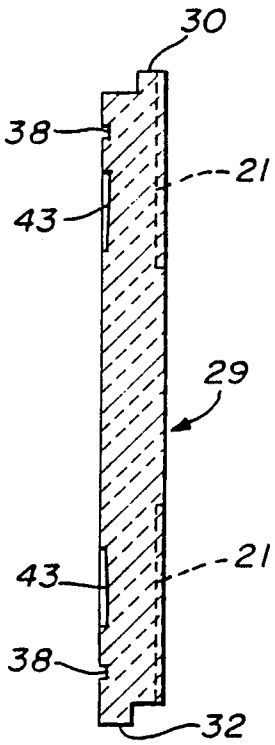
FIG. 5 is a cross-sectional view of the polystyrene panel taken along lines 5—5 of FIG. 4.
Figure 6:
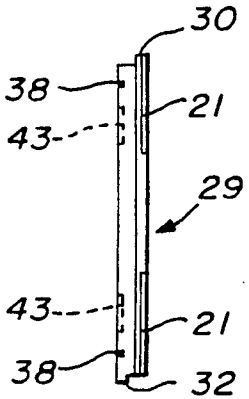
FIG. 6 is an end view of the novel polystyrene panel.

FIG. 5 is a cross-sectional view of the panel in FIG. 4 taken along lines 5—5. The top and bottom projections 30 and 32 can be seen, the rectangular recesses 38 are illustrated and the recesses 21 on the back side for the hinge plates 20 are also shown. The end view of the panel in FIG. 4 is illustrated in FIG. 6. The upper and lower projections 30 and 32 can be clearly seen, as well as the depressions 21 for the hinge plates 20.

Figure 7:
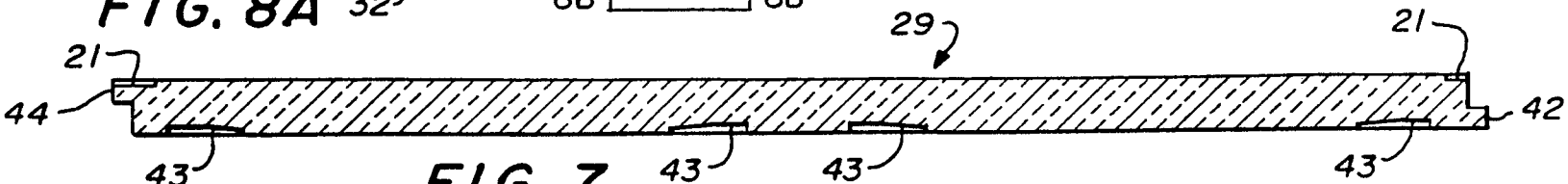
FIG. 7 is a cross-sectional view of the panel in FIG. 4 taken along lines 7—7.

FIG. 7 is a cross-sectional view taken along lines 7—7 of FIG. 4. L-shaped end projections 42 and 44 can clearly be seen. These projections are used to overlap adjacent panels so that a tight fit can be obtained for any length of door desired. One-half of the recess 21 for the hinge plate is illustrated at each end of the core member panel 29 in FIG. 7. FIG. 8A is a bottom view of the core panel illustrated in FIG. 4 and, again, the impressions or recesses 21 in which the hinge plates 20 fit can clearly be seen.

Figure 8B:
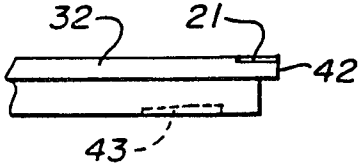
FIG. 8B is a partial view of the panel in FIG. 8A taken along lines 8B—8B.
Figure 8A:
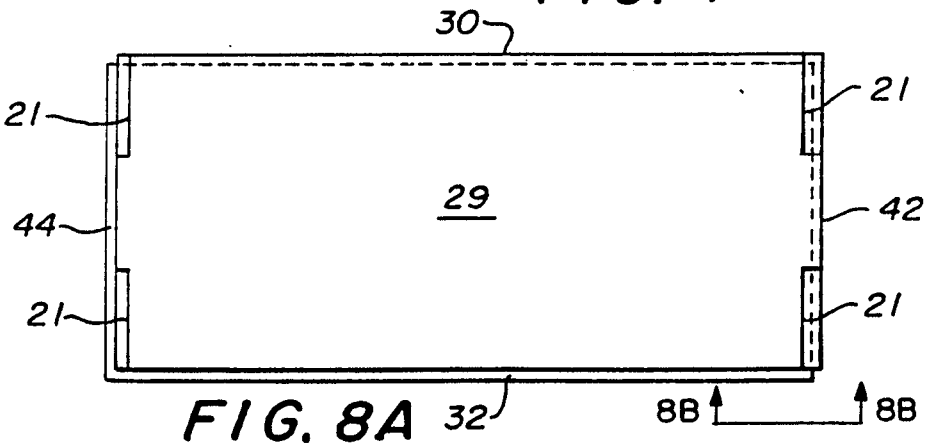
FIG. 8A is a back view of the novel polystyrene panel shown in FIG. 4.

FIG. 8B is a partial view taken along lines 8B—8B in FIG. 8A. FIG. 8B clearly illustrates the depression 21 for the hinge plate 20, the L-shaped end 42 which is used to overlap an adjacent end panel and the projection 32 on the bottom thereof that can be used to overlap an adjacent bottom panel under and adjacent the panel shown in FIG. 4 and FIG. 8A.

Figure 9:
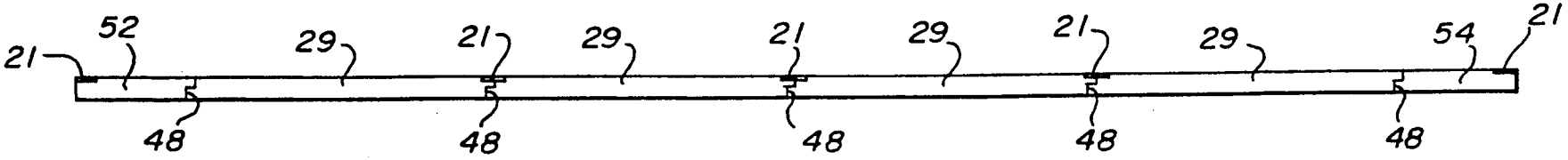
FIG. 9 is a top view of a plurality of the assembled polystyrene panels forming the core of a door panel.

FIG. 9 is a top view of the assembled panels 29 used to form the core. A number of panels 29 may be used depending upon the door width. Each pair of adjacent panels has an overlapping area 48 (formed from overlapping L-shaped ends 42 and 44) and the depressed or recessed area 21 for the hinges 20. The end pieces 52 and 54 are cut with a straight edge on the outer end so that outer ends do not have an L-shaped overlapping portion.

Figure 11:
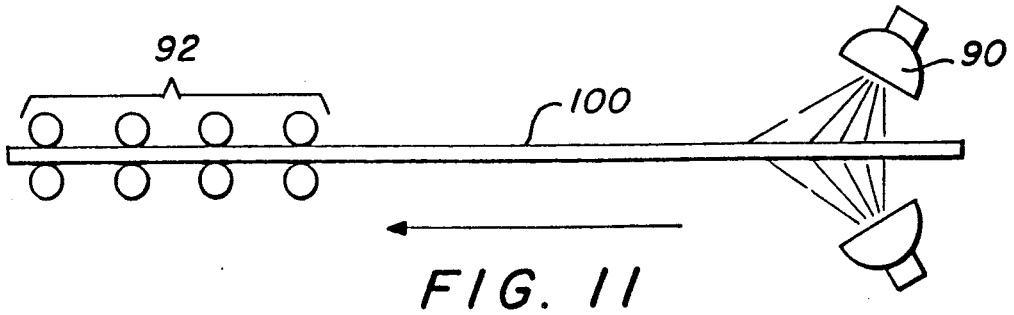
FIG. 11 illustrates the rollers and heat lamps that are used to bring the finished assemblies to a predetermined temperature before they are compressed between the rollers to ensure a stable bond between the steel skins and the polystyrene core.

FIG. 11 illustrates the final stage for completing the novel panels. The polystyrene core pieces or panels 29 are mated to the back of the metal front skin 26 with the pressure sensitive hot melt adhesive described hereafter. The inside of the metal back skin 28 is also mated to the back surface of the polystyrene panels 29 with the pressure sensitive hot melt adhesive. The entire unit or assembly as shown in FIG. 11 is passed between heat lamps 90 providing a temperature range of approximately 120°-135° F. to heat the adhesive sufficient to keep it soft and tacky. The assembly then passes between the sets of rollers 92 that compress the assembly approximately 0.050 inch with a pressure in the range of 15-20 psi. The travel speed of the assembly through the rollers is approximately 15-18 feet per minute. End caps 24 have an adhesive applied thereto of the type known as #34-2843 made by National Starch Co. and the end caps 24 are then attached to the ends of the final assembly to cover the exposed polystyrene core.

Figure 10:
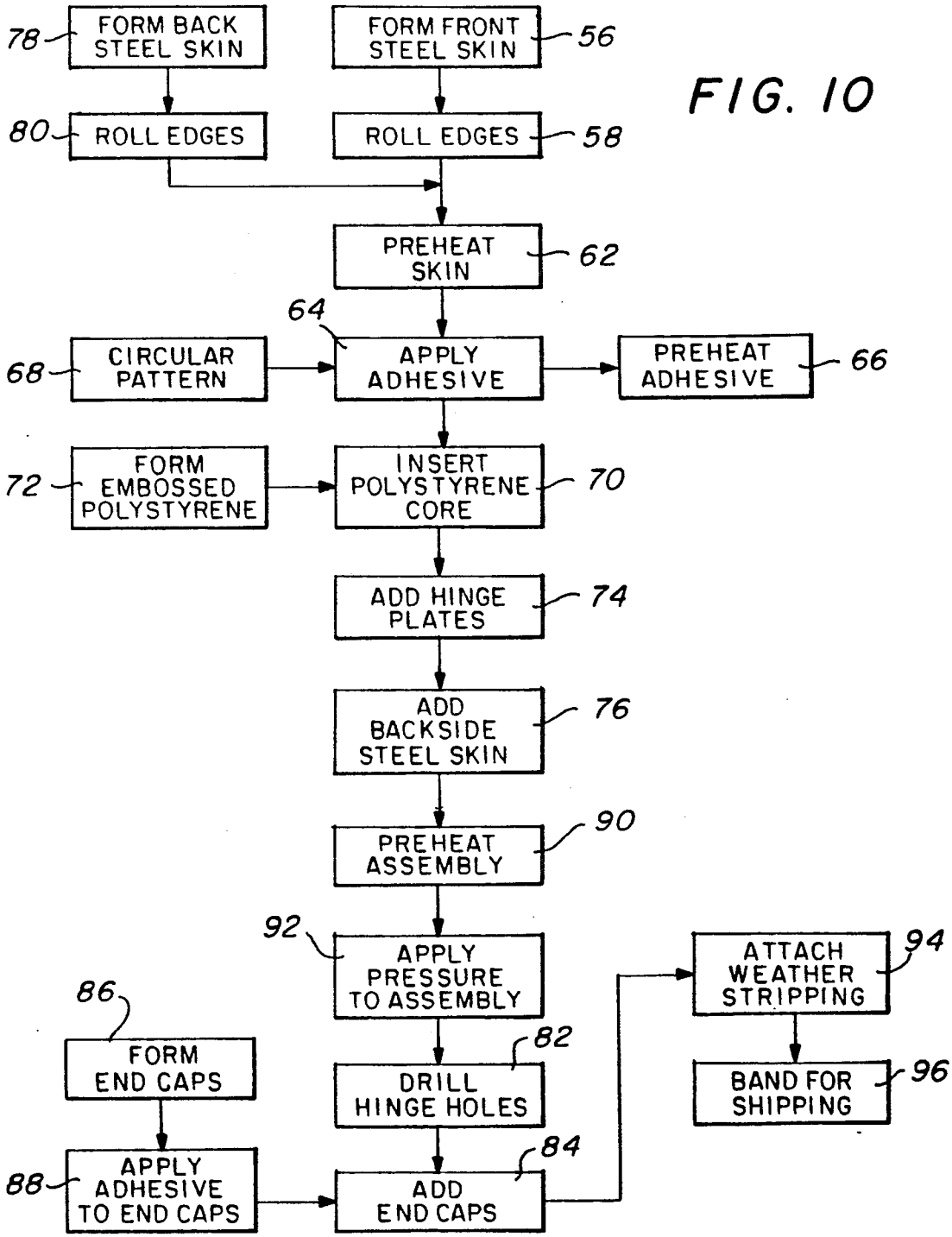
FIG. 10 is a flow chart illustrating the novel steps of the process of the present invention for making the door panels.

FIG. 10 is a flow chart illustrating the steps of the present invention. The front steel skin is formed at step 56 and any desired pattern is stamped or embossed therein. The edges of the front steel skin are rolled up at step 58. At step 62, the skin is preheated to a temperature in the range of 90°-110° F. This step is necessary because at the next step 64 adhesive is going to be applied and it is desirable, in forming a good bond between the steel skin and the polystyrene, that the glue be as close to its melt temperature as possible when the bond is formed. If the front skin formed at step 56 is cold, it will withdraw the heat from the glue and prevent it from making a good adhesion. The adhesive is preheated at step 66 to approximately 390°-425° F. and is then applied to the back side of the preheated front steel skin at step 64. The preheated adhesive is a hot melt pressure sensitive material and may be of the type manufactured by Findley Adhesives, Inc. and designated by the symbols H-2038. It is applied in a spray with a circular motion with nozzles at step 68 with a coverage of approximately 4.5 grams of adhesive per square foot of surface. The nozzles spray a circular pattern to ensure that the entire back side of the front embossed panel is covered with the adhesive.

At step 70, the polystyrene core is matched to the front steel skin. The polystyrene core had, previously, at step 72, been formed with the embossed format on one side that is substantially identical to the embossed design o the front steel skin 26 and is mated at step 70 to the back of the front steel skin. During the embossing of the polystyrene in step 72, depressions or recesses 21 are made on the back side for the metal hinge plates 20. These metal hinge plates 20 have a layer of the adhesive glue #34-2843 applied to them and they are then attached in the embossed areas on the polystyrene core at step 74 to hold them in place. At step 76, the back side steel skin is added. First, however, at step 78 the back side steel skin must be formed and in step 80 the edges are rolled so that they are in overlapping relationship with the rolled edges of the front steel skin. At step 82, hinge holes can be drilled through the outer skin into the steel plate assembly that is to be used as support for the hinges. At step 90, the entire assembly is again preheated in the range of 120°-135° F. This, again, is necessary to ensure that the temperature of the glue will be heated sufficiently to enable a good bond to take place. At step 92, the assembly is fed between nip rollers 92 to apply the pressure in the range of 15-20 psi thereto to compress the assembly approximately 0.050 inch and bond the steel to the polystyrene. At step 84, the end caps are added to each end of the device. The first step 86 forms the end caps and in the second step 88, adhesive is applied to the end caps and they are inserted on the ends of the panels as indicated by step 84. A retainer and attached weatherstripping unit shown in FIG. 3A is attached as step 94 to the bottom panel of the garage door to ensure a weather-tight seal. At step 96, the panels are banded together for shipping.

Thus, there has been disclosed a novel door and method for making the same of the type having a polystyrene core with a relatively porous surface that is bonded to a relatively slick metal surface. The door provides advantages over the prior art by maintaining the bond between the steel and the polystyrene even under high temperature conditions such as where the door is directly exposed to the sun all day. The present application, because of the bonding techniques, causes the door to maintain its unitary condition and the textured surface steel stays bonded to the porous polystyrene. Further, it utilizes pressure sensitive hot melt adhesive which has a nonsolvent base that is not dangerous to humans. In the prior art the solvents have to be taken out of the adhesive and flashed off by drying the units in an oven.

While the invention has been described in connection with a preferred embodiment, it is not intended to limit the scope of the invention to the particular form set forth, but, on the contrary, it is intended to cover such alternatives, modifications and equivalents as may be included in the spirit and scope of the invention as defined by the appended claims.

We claim:

1. A process of making a door comprising the steps of:

embossing a metal skin for the front of the door with a predetermined pattern;

molding polystyrene panels having the predetermined pattern on one side thereof and a relatively flush surface on the other side;

forming a substantially flush textured metal back skin;

preheating the embossed metal skin;

spraying a pressure sensitive hot melt adhesive on the back side of the preheated embossed skin;

mating the molded polystyrene panels with the corresponding pattern on the embossed metal pattern to form a first assembly having exposed polystyrene ends;

spraying the pressure sensitive hot melt adhesive on the inside of the metal back skin;

mating the adhesive side of the back skin to the molded panel side of the first assembly to form a second assembly having the panels as a core assembly;

heating the second assembly to a temperature sufficient to keep the hot melt adhesive soft and tacky; and applying pressure in the range of 15 to 20 psi to the front and back skins of the second assembly to create the adhesive bond between the skins and the panel.

2. A method as in claim 1 further comprising the steps of:

forming metal end caps to cover the exposed polystyrene ends of the second assembly applying hot melt adhesive to the inner side of the end caps and mating the end caps with the ends of the second assembly.

3. A method as in claim 1 wherein the step of applying pressure to said second assembly comprises the steps of:

establishing a series of pinch rollers; and guiding the second assembly between the pinch rollers at a rate in the range of 15 to 18 feet per minute to compress the second assembly approximately 0.050 inch.

4. A method as claim 3 further comprising the step of preheating the hot melt adhesive to a temperature in the range of 395° to 425° F. before being sprayed on the inside of the front and back metal skins.

5. A method as in claim 4 wherein the embossed metal skin is preheated prior to the application of the hot melt adhesive to a temperature sufficient to maintain said sprayed adhesive in a melted state with a given ambient temperature.

6. A method as in claim 5 wherein the preheated adhesive is sprayed on the steel embossed skin in the amount of approximately 4½ grams per square foot of surface.

7. A method as in claim 1 wherein the pressure sensitive hot melt adhesive sprayed on the front and back steel skins is of the type known as H-2038 manufactured by Findley Adhesives, Inc.

8. A method as in claim 1 further including the step of using a hot melt adhesive that is nonhazardous to humans and is made with a nonsolvent base.

9. A method as in claim 1 wherein the hot melt adhesive applied to the end caps is of the type known as No. 34-2843 manufactured by the National Starch Company.

10. A method as in claim 1 further comprising the step of applying the pressure sensitive hot melt adhesive to the front and back steel skins in the amount of substantially 4.5 grams per square foot of surface in a circular pattern to cover all of the surface of each skin to which the adhesive is being applied.

11. A method as in claim 1 further including the steps of:

forming metal hinge reinforcement plates; and forming appropriate recessed areas on the back of said polystyrene panels to receive the metal hinge reinforcement plates.

12. A method as in claim 11 further comprising the steps of:

applying one side of the hinge plates with hot melt adhesive; and attaching the one side of the hinge plates with the adhesive thereon to the recessed areas.

13. A method as in claim 1 further including the step of:

forming the polystyrene panels in sections, each section having L-shaped ends that overlap with adjacent panel L-shaped ends to form a continuous panel core.

* * * * *

UNITED STATES PATENT AND TRADEMARK OFFICE

CERTIFICATE OF CORRECTION

PATENT NO. : 5,125,155

DATED : June 30, 1992

INVENTOR(S) : Donald B. Kyle and Michael A. Frost

It is certified that error appears in the above-identified patent and that said Letters Patent is hereby corrected as shown below:

Column 1, line 12, after "It" insert -- is well --.

Column 5, line 59, delete "o" and insert therefor -- on --.

Column 7, line 8, after "assembly" insert -- ; --.

Column 7, line 10, after "caps" insert -- ; --.

Signed and Sealed this

Thirty-first Day of August, 1993

*Attest:*

*Attesting Officer*

BRUCE LEHMAN

*Commissioner of Patents and Trademarks*